US005447346A

United States Patent [19]

Virzi

[11] Patent Number: 5,447,346

[45] Date of Patent: Sep. 5, 1995

[54] PORTABLE, ADJUSTABLE, TELESCOPIC CLAMPING LOCK FOR TRUCK SLIDING WINDOWS

[75] Inventor: Al Virzi, Bloomfield Hills, Mich.

[73] Assignee: G&D Communications Corporation, Bloomfield Hills, Mich.

[21] Appl. No.: 260,341

[22] Filed: Jun. 15, 1994

[51] Int. Cl.[6] ..... E05C 19/18

[52] U.S. Cl. ..... 292/289; 292/258

[58] Field of Search ..... 292/288, 289, 259, 339, 292/262, DIG. 46, 302, 258, 295, 292, DIG. 6; 248/231.4

[56] References Cited

U.S. PATENT DOCUMENTS

| | | | |
|---|---|---|---|
| 1,467,363 | 10/1923 | Fairall . | |
| 2,495,860 | 1/1950 | Miller | 292/288 |
| 2,505,400 | 4/1950 | Hinds | 292/288 |
| 2,514,738 | 7/1950 | Bradley | 292/258 |
| 3,486,781 | 12/1969 | Crum | 292/262 |
| 3,606,421 | 10/1971 | Reichenbach | 292/288 |
| 3,797,005 | 3/1974 | Schwartz | 292/262 |
| 3,851,908 | 12/1974 | Hester et al. | 292/262 |
| 4,372,136 | 2/1983 | Mickelson | 292/288 X |
| 4,695,081 | 9/1987 | Boykin | 292/DIG. 6 X |
| 4,846,513 | 7/1989 | Mathis, II | 292/262 |
| 4,958,867 | 9/1990 | Champagne | 292/258 X |
| 4,971,374 | 11/1990 | Lovell et al. | 292/288 |
| 5,145,222 | 9/1992 | Meyer | 292/258 |
| 5,284,036 | 2/1994 | Rosenbaum | 292/258 X |

*Primary Examiner*—Peter M. Cuomo
*Assistant Examiner*—Monica E. Millner

[57] ABSTRACT

A portable, adjustable clamping lock for pickup truck sliding windows, having outer and inner telescopic tubes, (10), (12) respectively, of concentric nature, with affixed end plates (14), (16). These end plates having integral end plate clamping jaws (14*a*), (16*a*), and end plate spring hooks (14*b*), (16*b*), the hooks holding a tension spring (18), between the end plates, so that the telescopic tubes may be manually extended, against the tension of the spring, and collapsed and thereby adjusted to be installed on a variety of different size sliding windows with a firm grip being provided by the tension spring. The invention further having an adjusting/locking means comprised of an adjusting/locking knob (22), a tension bushing (24), a threaded stud insert (26) and a guide cylinder (20), so as to allow for the fixing of the amount of extension of the telescopic tubes, in such a manner that the tubes may not be further extended or collapsed unless the adjusting/locking means is released.

16 Claims, 2 Drawing Sheets

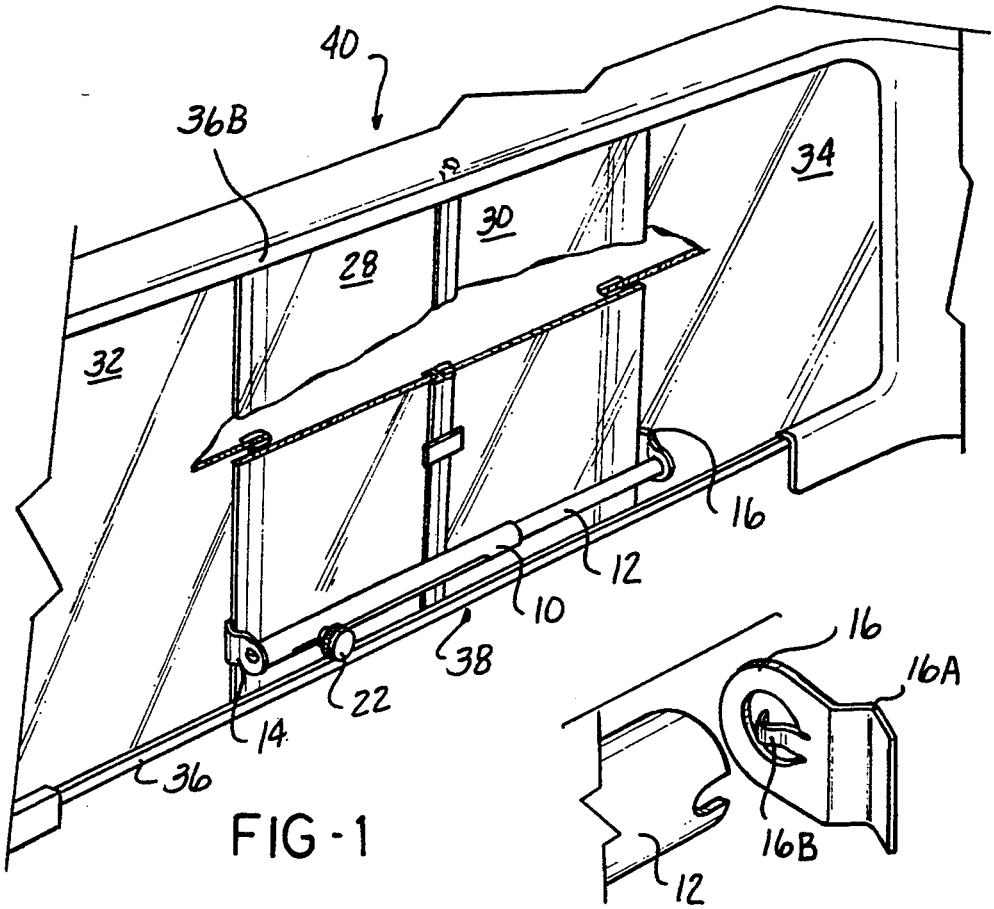
FIG-1
FIG-2
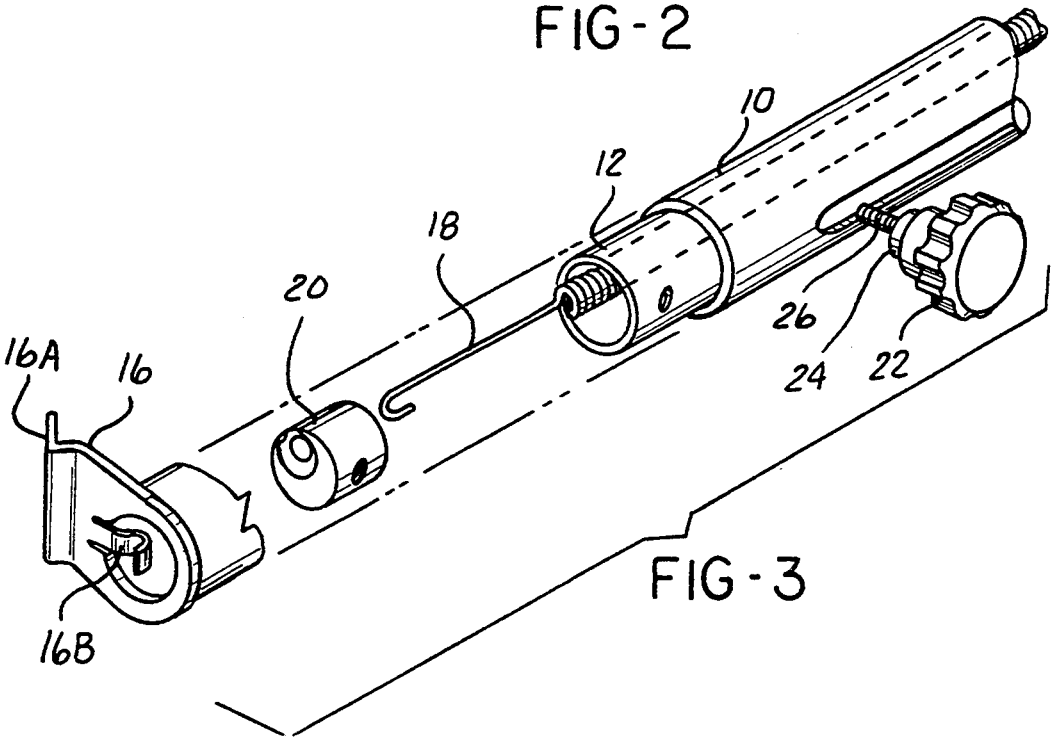
FIG-3

PORTABLE, ADJUSTABLE, TELESCOPIC CLAMPING LOCK FOR TRUCK SLIDING WINDOWS

BACKGROUND—CROSS REFERENCE TO RELATED INVENTIONS

| U.S. PATENT DOCUMENTS | | | |
|---|---|---|---|
| 2,900,679 | 8/1959 | Migneault | 20/52 |
| 3,055,064 | 9/1962 | Riegelman | 20/52 |
| 3,486,781 | 12/1969 | Crum | 292/262 |
| 3,732,709 | 5/1973 | Kneebone | 70/90 |
| 3,825,290 | 7/1974 | Messina et al | 292/262 |
| 3,927,906 | 12/1975 | Mieras | 292/262 |
| 3,993,336 | 11/1976 | Frost | 292/263 |
| 4,302,038 | 11/1981 | Ervine | 292/263 |
| 4,349,223 | 9/1982 | Spector | 292/259 R |
| 4,372,136 | 2/1983 | Mickelson | 70/14 |
| 4,493,501 | 1/1985 | Abel | 292/263 |
| 4,846,513 | 7/1989 | Mathis II | 292/262 |
| 4,875,349 | 10/1989 | Girard | 70/95 |
| 5,074,133 | 12/1991 | Simoncelli | 70/90 |

BACKGROUND—FIELD OF INVENTION

This invention relates to locking devices, specifically to such devices which are used for securing sliding windows found on pickup-type trucks.

BACKGROUND—DESCRIPTION OF PRIOR ART

Many pinkup trucks are equipped with slide-open rear windows consisting of, either a single sliding panel, or two coplanar slidable glass panels.

These windows are currently secured by means of inexpensive plastic or metal fasteners that span from the one moveable glass panel to the other, or from a single panel to a coplanar, fixed latch point.

These fasteners, however, do not provide a secure closure of the window. Because of their design, it is possible to easily gain entry through the window by inserting a narrow blade or similar tool between the sliding panels, and forcing the fastener to release.

Inventors have created several types of devices to provide security to sliding panels. U.S. Pat. No. 2,900,679 to Migneault (1959) discloses a permanently affixed roller clamp for sashless sliding windows. These clamps, however, require that the glass panels overlap and is not suitable for coplanar sliding panels. Also, the clamp requires a permanent mounting for the clamp, eliminating any portability. U.S. Pat. No. 3,055,064 to Riegelman (1962) is likewise a permanent installation for clamping a sliding panel, and therefore, not a portable device.

U.S. Pat. No. 3,486,781 to Crum (1969) discloses a permanently installed locking device in the form of a barrier, inserted into the path of the sliding panel. This same patent continues to disclose an adjustable, coaxial extension; however, this extension is only adjustable to predetermined fixed positions. Also, U.S. Pat. No. 3,732,709 to Kneebone (1973) discloses a non-portable, barrier type of device for overlapping panels only, which requires permanent installation.

In U.S. Pat. No. 3,825,290 to Messina et al. (1974), a hinged locking bar is disclosed to be permanently mounted and to secure overlapping sliding panels. This device, however, would not be adaptable to the sliding windows of pickup trucks, as two units would be required on opposite sides of the sliding panels.

U.S. Pat. No. 3,927,906 to Mieras (1975), and U.S. Pat. No. 3,993,335 to Frost (1976) both revert to a permanently installed barrier type device that is intended for use on overlapping panels only.

U.S. Pat. No. 4,302,038 to Ervine (1981) reverts to a hinged bar, intended to be permanently mounted, and to secure only one, overlapping panel. This device would not be suitable, as a pair of devices would be required, as in the discussion of U.S. Pat. No. 3,825,290 above.

U.S. Pat. No. 4,349,223 to Spector (1982) discloses a permanently installed, electrically powered, hinged door securing device that would be suitable only for use on a building or other large structure.

U.S. Pat. No. 4,372,136 to Mickelson (1983) discloses a portable hasp type lock. The device, however, is intended for use on hinged doors. The device also requires that the panels to be secured have significant protrusion that will allow attachment of the device. Furthermore, although adjustable, the device is only capable of limited, predetermined sizing, as discussed above regarding U.S. Pat. No. 3,486,781.

U.S. Pat. No. 4,493,501 to Abel (1985) discloses a hinged locking bar design. This device is not suitable for the same reasons discussed regarding U.S. Pat. Nos. 3,825,290 and 4,302,038 above.

The issue of securing the sliding panels of pickup trucks was addressed in U.S. Pat. No. 4,846,513 to Mathis II (1989). The invention consists of a large, cumbersome and complicated assembly, the goal of which is to secure the sliding panels by creating barriers to the opening of each individual sliding panel. The invention would not be desirable for use on a window with a single sliding panel, as there would be the redundancy of an additional barrier device where none was required. Also, the invention requires the user to raise and lower the entire assembly, through a number of awkward steps, when placing in and out of service. Said patent further discloses that the invention uses adjustable, telescoping barriers, using the same type of predetermined fixed point adjustments as discussed in other prior art, i.e., U.S. Pat. Nos. 3,486,781 and 4,372,136, and as a result, the barriers will not provide a positive contact closure of all the various sizes of sliding panels in use. Furthermore, the size and construction of the invention precludes its easy removal and installation into different vehicles. Therefore it is not truly portable.

U.S. Pat. No. 4,875,349 to Girard (1989) discloses a barrier type of device that must be permanently installed, and is effective only on offset sliding panels.

Also a permanently installed device, is U.S. Pat. No. 5,074,133 to Simoncelli (1991), which requires the modification of one of the sliding panels in order to accept the aforementioned permanent installation.

OBJECTS AND ADVANTAGES

Accordingly, the objects and advantages of the Telescopic Lock are:

(a) to provide a portable clamping lock that can easily be transported from vehicle to vehicle;

(b) to provide a lock that is infinitely adjustable throughout its range so as to correctly fit the span of any available truck sliding rear window;

(c) to provide a clamping lock that provides positive, continuous pressure on the coplanar, sliding panels to prevent unwanted entry;

(d) to provide a clamping lock that is a single unit, convenient, effective, attractive, compact and easy to install, remove, and store.

Still further objects and advantages of the Telescopic Lock will become apparent from a consideration of the ensuing description and drawings.

DRAWING FIGURES

FIG. 1 shows the Telescopic Lock mounted in position on the coplanar sliding panels of a typical sliding window assembly.

FIG. 2 shows the end of the telescopic tube and the end plate.

FIG. 3 shows a cutaway view of the interior Telescopic Lock assembly.

REFERENCE NUMERALS IN DRAWINGS

Figure 4:
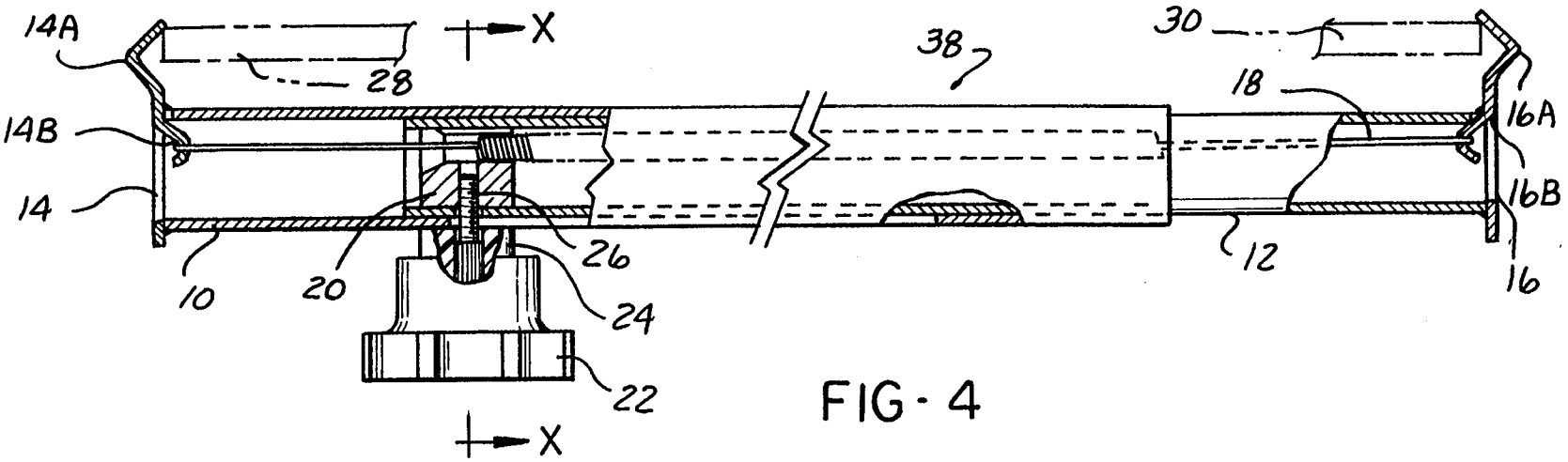
FIG. 4 shows a cutaway view of the entire invention.

| | | | |
|---|---|---|---|
| 10 | outer telescopic tube | 12 | inner telescopic tube |
| 14 | outer tube end plate | 14a | end plate clamping jaw |
| 14b | end plate spring hook | 16 | inner tube end plate |
| 16a | end plate clamping jaw | 16b | end plate spring hook |
| 18 | tension spring | 20 | guide cylinder |
| 22 | adjusting/locking knob | 24 | tension bushing |
| 26 | threaded stud insert | 28 | left side sliding panel |
| 30 | right side sliding panel | 32 | left side fixed panel |
| 34 | right side fixed panel | 36a | lower sliding panel track |
| 36b | upper sliding panel track | 38 | Telescopic Lock |
| 40 | rear window assembly | | |

DESCRIPTION OF THE PREFERRED EMBODIMENTS

As shown in FIG. 1, a rear window assembly 40 of a pickup truck possessing a pair of coplanar sliding glass panels 28, 30 mounted within an upper and lower sliding panel track 36*a*, 36*b* respectively, and overlapping on the interior, a pair of fixed glass panels 32, 34 so that sliding panels 28, 30 may be opened by sliding them horizontally away from the center of window assembly 40.

Said figure further illustrates the Telescopic Lock 38, installed on sliding panels 28, 30 and thereby securing them in the closed position via an inner telescopic tube 12 with an attached inner tube end plate 16 and an integral end plate clamping jaw 16*a*, having been positioned on sliding panel 30, and telescoped out from its resting place within an outer telescopic tube 10 with an attached outer tube end plate 14, having been positioned on sliding panel 28, telescopic tubes 10, 12 are compressed together and Telescopic Lock 38 is locked in place using an adjusting/locking knob 22, thus securing sliding panels 28, 30 and preventing any sliding movement thereof until Telescopic Lock 38 is released.

As shown in FIG. 2 tube end plate 16, which is attached to telescopic tube 12, and consists of two integral components, end plate clamping jaw, 16*a* and an end plate spring hook 16*b*. The corresponding integral components for end plate 14 (identical to end plate 16) are shown in FIG. 4.

FIG. 3 The Telescopic Lock 38 provides constant compression pressure, pushing sliding panels 28, 30 (not shown) closed via a tension spring 18. The figure illustrates that tension spring 18, is contained inside telescopic tubes 10, 12, travels through a guide cylinder 20, and attaches to end plate spring hooks 14*b* (not shown), 16*b*. Guide cylinder 20, which is affixed to the inside of inner telescopic tube 12, is equipped with a female threaded hole, which aligns with both a through-hole in inner telescopic tube 12, and an adjusting slot in outer telescopic tube 10, allowing guide cylinder 20 to receive a threaded stud insert 26 which, carrying a tension bushing 24, is attached to adjusting/locking knob 22. This sub-assembly allows adjusting/locking knob 22, to be tightened in such a way as to clamp telescopic tubes 10, 12 in any degree of extension allowed by the length of the adjusting slot in outer telescopic tube 10, and threaded stud insert 26 which also acts as a stop to prevent hyperextension or compression of telescopic tubes 10, 12.

FIG. 4 shows Telescopic Lock 38 as a complete assembly. Outer telescopic tube 10, surrounds inner telescopic tube 12, each having their respective tube end plates 14, 16 attached. Attached to the integral end plate spring hooks 14*b*, 16*b* is tension spring 18, which runs through guide cylinder 20, that is fastened to the inside of inner telescopic tube 12. Adjusting/locking knob 22, is attached to Telescopic Lock 38 via threaded stud insert 26, which passes through tension bushing 24, the adjusting slot in outer telescopic tube 10, and the through-hole in inner telescopic tube 12, and fastens into the female threaded hole in guide cylinder 20. Invention 38 may then be operated by manually increasing the span of telescopic tubes 10, 12 and placing end plate clamping jaws 14*a*, 16*a*, around sliding panels 28, 30, when the tube sections are released, tension spring 18 contracts the tubes together and provides strong inward pressure on said panels. Telescopic Lock 38 is then locked in place by tightening threaded stud insert 26, into the guide cylinder 20, by turning adjusting/locking knob 22 until the tension bushing 24, is compressed. Telescopic Lock 38 is then locked and telescopic tubes 10, 12 and therefore, sliding panels 28, 30 cannot be forced to open until adjusting/locking knob 22 is released.

Figure 5:
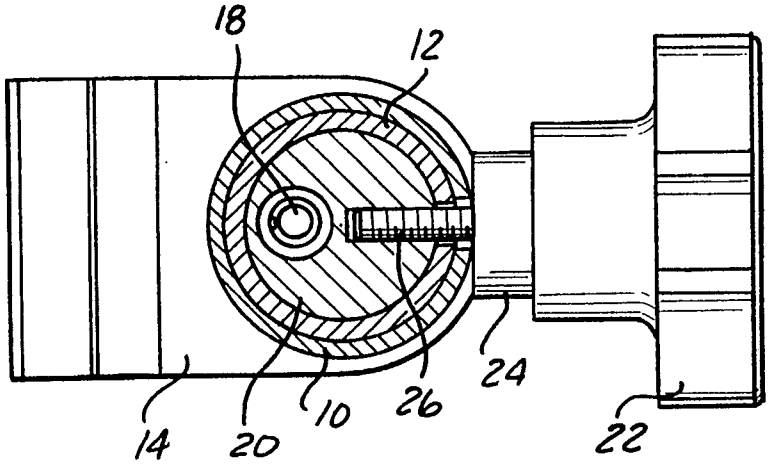
FIG. 5 shows a cross sectional view along X of FIG. 4

FIG. 5 shows an end view Telescopic Lock 38 with a cross section at position X of FIG. 4. Outer and inner telescopic tubes 10, 12 shown are concentric and are of such diameters and wall thicknesses that they telescope easily without binding or free play. Fastened within inner telescopic tube 12 is guide cylinder 20, with tension spring 18 shown passing through the guide hole, allowing tension spring 18 to traverse the length of both telescopic tubes and attach to end plate spring hooks 14*b*, 16*b* (not shown) as described above. Adjusting/locking knob 22 is attached via threaded stud insert 26, after passing through tension bushing 24, outer and inner telescopic tubes 10, 12, and threading into guide cylinder 20. When adjusting/locking knob 22, is turned in such a manner as to compress tension bushing 24, threaded stud insert 26, screws into guide cylinder 20, pulling said cylinder, inner telescopic tube 12, and outer telescopic tube 10, toward adjusting/locking knob 22. The pressure created by this action pinches said tubes 10, 12 against each other and prevents further movement of said tubes 10, 12 until said knob 22 is released.

CONCLUSIONS, RAMIFICATIONS, AND SCOPE OF INVENTION

Accordingly, the reader will see that this telescopic clamping lock, in conformity with the invention contributes a novel, unobvious, improvement to the security of sliding truck windows, because of its unique design, its convenient size, its function ability, its complete adjustability and its ease of installation removal storage and portability.

Although the description above contains many specificities, these should not be construed as limiting the scope of the invention but as merely providing illustrations of some of the presently preferred embodiments of the Telescopic Lock. For example, the tubing can have other shapes such as square, oval, triangular etc., or be constructed of a variety of materials; the knob may be of other shapes or materials; the end plates may be of other shapes or materials, etcetera.

Thus the scope of the Telescopic Lock should be determined by the appended claims and their legal equivalents, rather than by the examples given.

I claim:

1. A telescopic locking device for use in securing sliding panels on vehicles, said device comprising:

a pair of telescopic tubes, each of said pair of telescopic tubes having portions defining a passage;

a guide member disposed in said passage of one of said pair of telescopic tubes;

a first end cap affixed to one of said pair of telescopic tubes, said first end cap having an appendage, said appendage engaging one of the sliding panels;

a second end cap affixed to the other of said pair of telescopic tubes;

a tension device attached to said first end cap and to said second end cap, said tension device biasing said first end cap toward said second end cap; and a lock connecting one of said pair of telescopic tubes to the other of said pair of telescopic tubes, said lock fixing an extensible length of said pair of telescopic tubes.

2. A device as claimed in claim 1 wherein said tension device is a spring.

3. A device as claimed in claim 1 wherein said lock threadably engages one of said pair of telescopic tubes.

4. A device as claimed in claim 1 wherein said tension device is disposed within said passages of each of said pair of telescopic tubes.

5. A device as claimed in claim 1 wherein said guide member having portions defining a cavity.

6. A device as claimed in claim 5 wherein one of said pair of tubes having portions defining a slot.

7. A telescopic tube as claimed in claim 6 wherein said lock having an appendage engaging said cavity in said guide member, said lock frictionally engaging said pair of telescopic tubes to prevent relative movement of one of said pair of telescopic tubes to the other of said pair of telescopic tubes and wherein said appendage extends through said slot so as to prevent the hyperextension of said pair of telescopic tubes in one predetermined condition and the over-compression of said pair of telescopic tubes in another predetermined condition.

8. A sliding panel locking device comprising:

an adjustable-length rod having a tubular outer member and an inner member telescopically received in said tubular outer member so as to provide a range of adjustment, said outer member having one end, said inner member having another end and portions defining a cavity;

a guide member disposed in said cavity of said inner member;

a tension device attached to said one end of the outer member said tension device further biasing said one end of the outer member toward said other end of the inner member; and a clamp member attached to said adjustable length rod so as to fix an extensible length of said adjustable-length rod.

9. A locking device as claimed in claim 8 wherein said adjustable-length rod having a portion defining a slot and wherein said clamp member having an extensible member which is passed though said slot and is connected to said guide member.

10. A locking device as claimed in claim 9 wherein said guide member having portions defining a passage, wherein said outer tubular element having a portion defining a void and wherein said tension member is passed through said void in said outer tubular element and through said passage in said guide member.

11. A locking device as claimed in claim 9 wherein said clamp member further having a knob portion adjacent to said extensible member.

12. A locking device as claimed in claim 8 wherein said clamp member further having a knob portion adjacent to said extensible member, said extensible member connected to said guide member.

13. A coplanar sliding panel locking device for use in securing a pair of sliding panels comprising:

a first tubular member having a first end which engages one of the pair of sliding panels;

a second tubular member slidably mounted within said first tubular member, said second tubular member having one end which engages the other of said pair of sliding panels;

a spring member attached to said first and second tubular members, said spring urging one of the pair of sliding panels toward the other of the pair of sliding panels; and a friction member attached to said first tubular member, said friction member further fixing the extensible length of said first and second tubular members, said friction member further including:

a guide member disposed in said second tubular member, said guide member further having portions defining a threaded passage; and said friction member further having a knob portion and a threaded appendage extending from said knob portion, said threaded appendage engaging said threaded passage in said guide member.

14. A coplanar sliding panel locking device as claimed in claim 13 wherein said first tubular member having a portion defining a slot, said threaded appendage disposed through said slot so as to prevent the hyperextension of said first tubular member and said second tubular member in one predetermined condition and the over-compression of said first tubular member and said second tubular member in another predetermined condition.

15. A coplanar sliding panel locking device as claimed in claim 13 wherein said friction member having a knob portion and a threaded appendage extending from said knob portion.

16. A coplanar sliding panel locking device as claimed in claim 13 wherein said threaded appendage engages said threaded passage in said guide member to frictionally clamp said first tubular member and said second tubular member together.

* * * * *